United States Patent [19]

Bronstien, Jr.

[11] 3,950,797

[45] Apr. 20, 1976

[54] MATTRESS BASE

[75] Inventor: Edward L. Bronstien, Jr., St. Paul, Minn.

[73] Assignee: The United States Bedding Company, St. Paul, Minn.

[22] Filed: Aug. 22, 1974

[21] Appl. No.: 499,552

[52] U.S. Cl. ..... 5/200 R; 5/345 R; 5/353.3

[51] Int. Cl.[2] ..... A47C 23/05

[58] Field of Search ..... 5/200 R, 201, 345 R, 5/351, 353.2, 353.3, 353.4, 353.5

[56] References Cited

UNITED STATES PATENTS

| | | | |
|---|---|---|---|
| 1,292,290 | 1/1919 | Foill | 5/353.5 |
| 1,339,537 | 5/1920 | Wiselogel | 5/353.5 |
| 1,454,577 | 5/1923 | Eyster | 5/351 X |
| 2,485,493 | 10/1949 | Jacobs | 5/285 |
| 2,649,898 | 8/1953 | Quakenbush | 5/353.3 |
| 2,841,209 | 7/1958 | Wetzler | 5/200 R |
| 2,908,918 | 10/1959 | Hopkes | 5/200 R |
| 3,076,979 | 2/1963 | Hopkes | 5/246 |
| 3,118,153 | 1/1964 | Hood | 5/345 R |
| 3,506,986 | 4/1970 | Lovette | 5/200 R |
| 3,810,264 | 5/1974 | Mueller | 5/310 |

FOREIGN PATENTS OR APPLICATIONS

| | | | |
|---|---|---|---|
| 667,282 | 2/1952 | United Kingdom | 5/353.3 |
| 617,710 | 4/1961 | Canada | 5/353.4 |

*Primary Examiner*—Roy D. Frazier
*Assistant Examiner*—Thomas J. Holko
*Attorney, Agent, or Firm*—Mason, Kolehmainen, Rathburn & Wyss

[57] ABSTRACT

A mattress base or support member is formed by a metal frame assembly having a plurality of metal frame members that define the outer periphery of the mattress base and that support a plurality of struts for alternately mounting a resilient cushion, such as a sheet of polyurethane foam, thereon to form a foundation when the frame assembly is disposed in a first condition or mounting a spring assembly thereon to form a box or inner spring when the frame assembly is disposed in a second, inverted condition. The frame assembly includes corner braces disposed at each corner that receive and retain vertical support means, such as legs, rollers or casters, thereby eliminating the customary lowermost adjustable bed frame. A fabric cover is placed over either the box spring or the foundation and is secured to the frame assembly by a resilient clip band, which is preferably sewn to the lowermost edges of the cover, to form an upholstered mattress base.

26 Claims, 7 Drawing Figures

MATTRESS BASE

BACKGROUND OF THE INVENTION

A. Field of the Invention

The device of the present invention generally relates to bedding apparatus and, more particularly, to a new and improved mattress base or support member and frame assembly therefor that alternately forms a box or inner spring or a foundation.

B. Description of the Prior Art

A typical prior art bed assembly includes a mattress disposed above and supported by a box or inner spring, both of which are disposed above and supported by a lowermost adjustable frame. The adjustable frame typically includes four vertical support means, such as legs, rollers or casters, and maintains the bed assembly at a predetermined distance above the floor. An acceptable substitute for the box spring in supporting a mattress is a foundation that is formed by a solid resilient cushion, such as a sheet of polyurethane foam, disposed on a suitable frame.

Since it is desirable that a mattress be disposed above the floor at a generally uniform height, it is important that the box spring and the foundation have substantially the same thicknesses. A typical spring assembly for use in a box spring that provides the desired combination of resiliency and firmness is approximately 6 inches thick. Since it is desirable that the foundation used as a substitute for the box spring have the same thickness as the box spring, a 6 inches thick resilient cushion, such as a sheet of polyurethane foam, could be used in place of a spring assembly. However, a 6 inches thick sheet of polyurethane foam is relatively quite expensive.

It has been found that a 3 inches thick sheet of polyurethane foam provides the desired combination of resiliency and firmness at a substantially lower cost than the cost of a 6 inches thick sheet of polyurethane foam. Thus, the typical practice in the prior art has been to use a thicker foundation frame assembly to support the solid resilient cushion than the box spring frame assembly used to support the spring assembly. For this reason, inventories of the two frame assemblies are required to be kept, resulting in an increase in costs and bookkeeping efforts.

The prior art includes several disclosures of mattress bases that include mattress base frame assemblies capable of directly receiving vertical support means, such as legs, rollers or casters, thereby eliminating the need for an adjustable lowermost frame. For example, such mattress bases are disclosed in U.S. Pat. Nos. 2,908,918 and 3,076,979. The mattress bases disclosed in these prior art patents further function to support mattresses of different thicknesses above the mattress bases at the same height above the floor. That is, when disposed in the first condition, each of the frame assemblies of the mattress bases receive and support a mattress of a first thickness. When disposed in a second, inverted condition, each of the frame assemblies of the mattress bases receive and support a mattress of a different thickness at the same height above the floor. However, the prior art has not addressed or solved the problem of providing a single mattress base frame assembly that can be used to alternately support a spring assembly or support a resilient cushion to thereby eliminate the requirement for maintaining stocks of at least two different frame assemblies.

SUMMARY OF THE INVENTION

An object of the present invention is to provide a new and improved upholstered article of manufacture.

Another object of the present invention is to provide a new and improved upholstered mattress base or support member that includes a fabric cover affixed thereto by the resilient engagement of a resilient clip band—with the frame assembly of the mattress base.

Another object of the present invention is to provide a new and improved mattress base or support member.

Another object of the present invention is to provide a new and improved mattress base or support member having a frame assembly for alternately supporting a spring assembly to form a box or inner spring or supporting a solid resilient cushion to form a foundation.

Another object of the present invention is to provide a new and improved mattress base or support member having a frame assembly capable of supporting either a spring assembly to form a box or inner spring or a resilient cushion to form a foundation and capable of receiving and retaining a plurality of vertical support means, such as legs, rollers or casters to thereby eliminate the requirement for a lowermost adjustable bed frame.

Briefly, the device of the present invention comprises a mattress base or support member having a metal frame assembly that, when disposed in a first condition, receives and supports a solid resilient cushion, such as a sheet of polyurethane foam, to form a foundation or, when disposed in a second, inverted condition, receives and supports a spring assembly to form a box or inner spring. The frame assembly is formed by a plurality of metal frame members that define the outer periphery of the mattress base and that, in a preferred embodiment, are interconnected to form a generally four-sided base member. The frame assembly also includes a plurality of struts or stringers that are mounted to the frame members. Disposed in each of the corners of the frame assembly is a corner brace to which may be attached a vertical support means, such as a leg, roller or caster. Thus, the need for the customary lowermost adjustable bed frame is eliminated.

When used as a frame assembly for a foundation, a planar sheet or member, such as a sheet of cardboard, is disposed above the plurality of struts and is affixed by glue or cement to the frame members. Thereafter, the solid resilient cushion, such as a 3 inches thick sheet of polyurethane foam, is disposed on the planar sheet and, if desired, may be glued or cemented thereto. A fabric cover is then drawn over the resilient cushion and the frame assembly and is secured thereto to form an upholstered foundation for a mattress. Preferably, the fabric cover is secured to the frame assembly by the resilient engagement of a resilient clip band sewn to the lowermost edges of the fabric cover with flange portions of the frame members of the frame assembly.

When used as a frame assembly for a box or inner spring, the frame assembly is inverted and a spring assembly, typically formed by a plurality of interconnected coil springs, is secured to the struts in any desired manner. Thereafter, the fabric cover is drawn over the spring assembly and frame assembly and is secured thereto to form an upholstered box or inner spring for a mattress. In this manner, a single frame assembly may be used to alternately form a foundation for a mattress or form a box or inner spring for a mattress.

BRIEF DESCRIPTION OF THE DRAWING

The above and other objects and advantages and novel features of the present invention will become apparent from the following detailed description of a preferred embodiment of the invention illustrated in the accompanying drawing wherein.

DESCRIPTION OF THE PREFERRED EMBODIMENT

Figure 1:
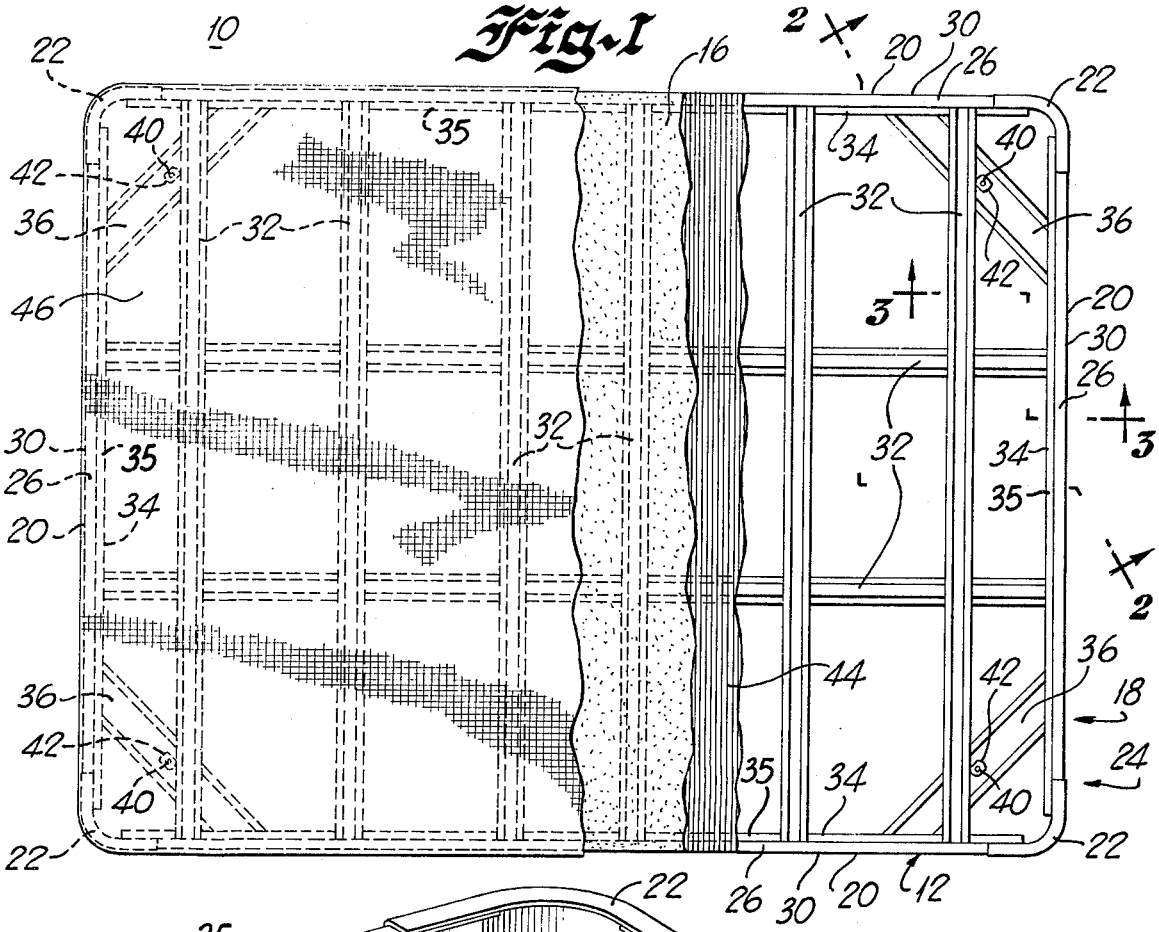
FIG. 1 is a partially cut-away, top plan view of a preferred embodiment of a mattress base constructed in accordance with the principles of the present invention.
Figure 2:
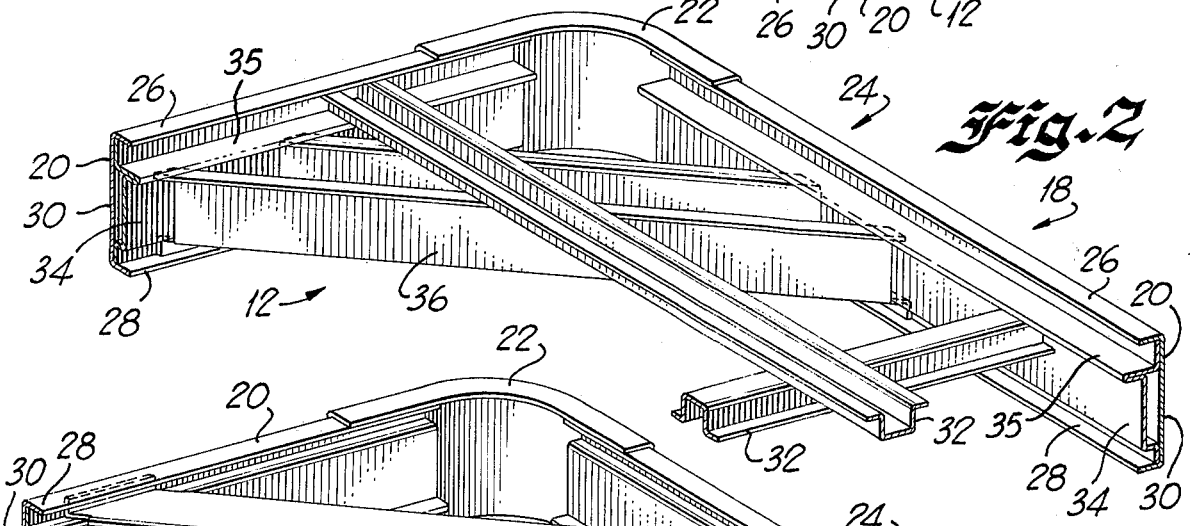
FIG. 2 is an enlarged, fragmentary, upper perspective view of a portion of the device of FIG. 1 taken from line 2—2 of FIG. 1.
Figure 4:
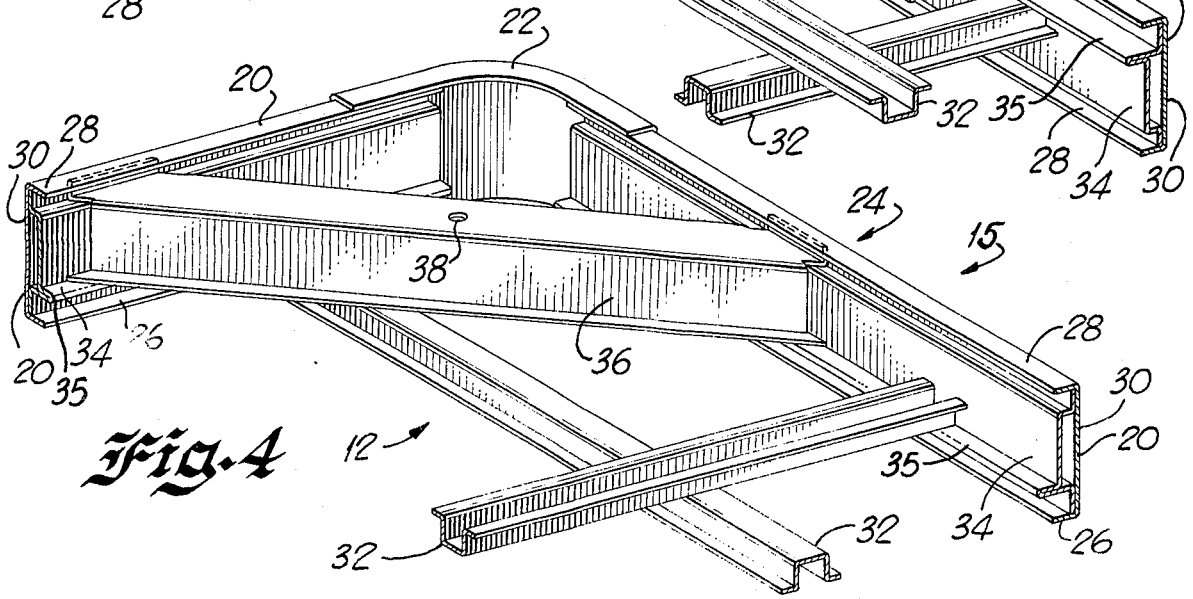
FIG. 4 is an enlarged, fragmentary view similar to the view set forth in FIG. 2 illustrating an alternate mode of the device in FIG. 1.
Figure 3:
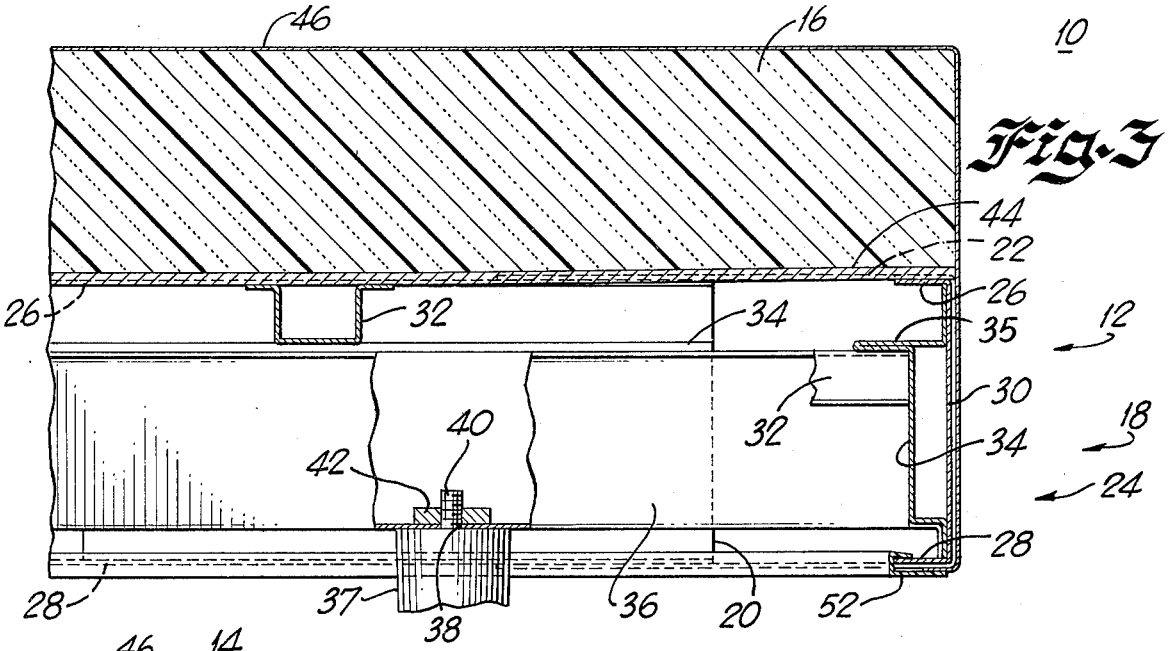
FIG. 3 is an enlarged, fragmentary, cross-sectional view of a portion of the device of FIG. 1 taken along line 3—3 of FIG. 1.
Figure 5:
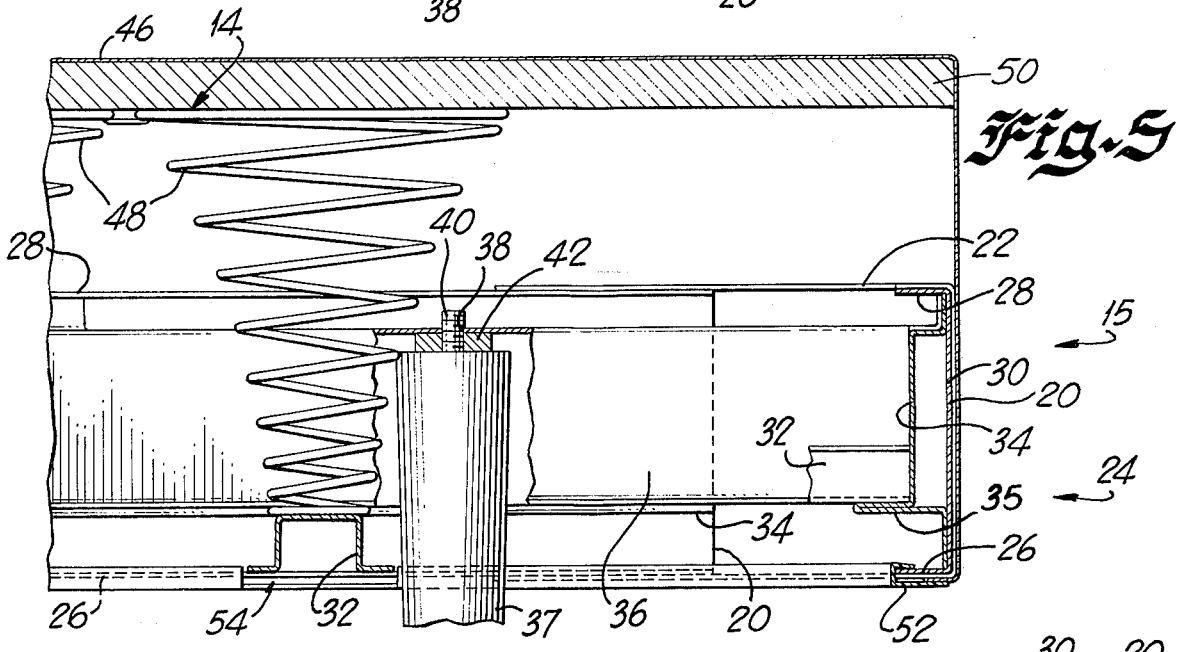
FIG. 5 is an enlarged, fragmentary, cross-sectional view similar to the view set forth in FIG. 3 but illustrating an alternate mode of the device of FIG. 1.

Referring to the drawing and initially to FIGS. 1 through 5, there is illustrated a new and improved upholstered article of manufacture or mattress base 10 constructed in accordance with the principles of the present invention. The mattress base 10 includes a rigid, metal frame assembly 12 that, when disposed in a first condition, receives and supports a spring assembly 14 to form a box or inner spring 15 for a mattress. When disposed in a second, inverted condition, the frame assembly 12 receives and supports a solid resilient cushion 16, preferably a 3 inches thick sheet of polyurethane foam, to form a foundation 18 for a mattress. In this manner, a single frame assembly 12 may be used to form either the box or inner spring 15 or the foundation 18.

In accordance with an important feature of the present invention, the frame assembly 12 is formed by a plurality of four metal frame or channel members 20 interconnected by a plurality of four metal curved joints 22 to form a rigid metal base member 24. The frame members 20 are secured to the curved joints 22 by any suitable means, such as by a plurality of spot welds. Each of the frame members 20 and the curve joints 22 of the base member 24 include a substantially U-shaped cross-sectional configuration in a plane transverse to the longitudinal axis of the frame members 20 and the curved joints 22. More specifically, each of the frame members 20 and curved joints 22 includes a first elongated flange portion 26 spaced from a second elongated flange portion 28 by a base portion 30.

The frame assembly 12 further includes a plurality of support struts or stringers 32 extending across the base member 24 and mounted therein by a plurality of four similarly shaped stringer support members 34 that are affixed to and extend across the base portions 30 of the frame members 20. The support struts 32 are secured to flange portions 35 of the support members 34 and the support members 34 are secured to the base portions 30 by any convenient means, such as by a plurality of spot welds.

Disposed in each of the corners of the base member 24 and extending between adjacent frame members 20 is a generally U-shaped, rigid corner brace 36. The corner braces 36 add rigidity to the base member 24, especially in the corner regions of the base member 24. Further, each of the corner braces 36 includes means for receiving a vertical support member 37, for example, a bed leg, roller or caster, for vertically supporting the mattress base 10 at a predetermined height above the floor. In a preferred embodiment, the means for receiving the vertical support member 37 comprises an aperture 38. In order to secure the vertical support member 37 to the corner brace 36, a threaded end portion 40 of the vertical support member 37 is received through the aperture 38 and is fixedly retained therein by its threaded engagement with a threaded locking nut 42. Preferably, the nut 42 is fixedly attached to the corner brace 36, for example, by spot welding.

In accordance with an important feature of the present invention, when the frame assembly 12 is disposed in a first condition (FIGS. 1, 2 and 3), the frame assembly 12 is in condition for receiving and securely mounting the resilient cushion 16 thereto to form the foundation 18. In order to mount the resilient cushion 16 to the frame assembly 12, a planar sheet or member 44, such as a sheet of cardboard, is positioned above the support struts and is securely fastened to the base member 24 in any conventional manner, such as by gluing or cementing the planar sheet 44 to the flange portions 26 of the frame members 20 and of the curve joints 22. Subsequently, the solid resilient cushion 16, for example, a 3 inches thick sheet of polyurethane foam, is placed on and secured to the planar sheet 44 by gluing or cementing the resilient cushion 16 thereto. Finally, a fabric cover 46 is drawn over the resilient cushion 16, the planar sheet 44 and the frame assembly 12 and is secured to the frame assembly 12 to form an upholstered foundation 18 for a mattress.

In accordance with a further important feature of the present invention, the frame assembly 12 may be disposed in a second, inverted condition (FIGS. 4 and 5) in order to receive and securely mount the spring assembly 14 thereto to form the box or inner spring 15. The spring assembly 14 is conventional and typically is formed by a plurality of interconnected coil springs 48 which are approximately 6 inches in length in a non-compressed condition. The coil springs 48 are mounted on and secured to the support struts 32 in any conventional manner. If desired, shorter coil springs may be mounted on and secured to the uppermost portions of the corner braces 36 in order to provide resilient support for a mattress in the corner regions of the mattress base 10.

After the spring assembly 14 is mounted on and secured to the frame assembly 12, a protective pad 50 is disposed over the spring assembly 14 to protect the fabric cover 46 from being damaged by the coil springs 48. The fabric cover 46 is drawn over the protective pad 50, the spring assembly 14 and the frame assembly 12 and is secured to the frame assembly 12 to form an upholstered box or inner spring 15 for a mattress.

In order to support a mattress at the same height, longer vertical support members 37 are secured to the corner braces 36 when the mattress base 10 takes the form of the box or inner spring 15 than the vertical support members 37 used when the mattress base 10 takes the form of the foundation 18.

Figure 6:
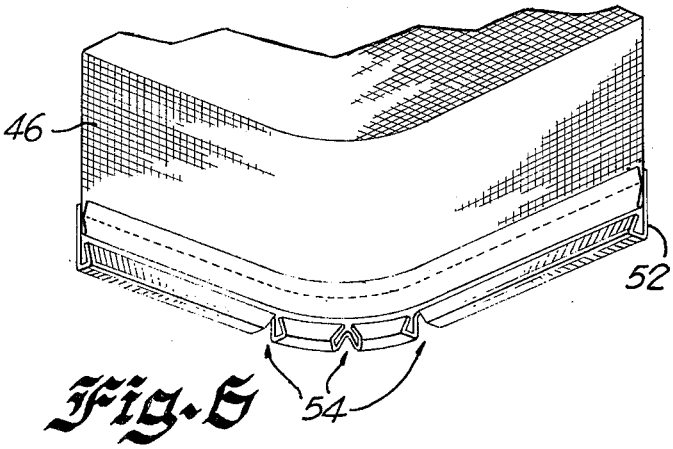
FIG. 6 is an enlarged, fragmentary, perspective view of a portion of the device of FIG. 1.
Figure 7:
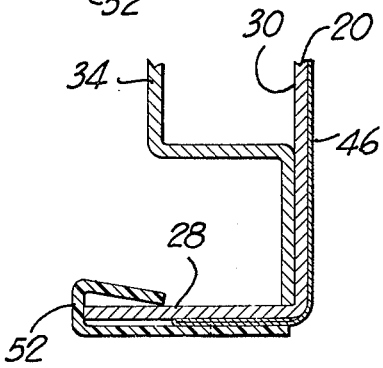
FIG. 7 is an enlarged, fragmentary, detail view of a portion of the device of FIG. 1.

In accordance with an important feature of the present invention, the fabric cover 46 (FIGS. 1, 3 and 5 through 7) includes means for securing the fabric cover 46 to the frame assembly 12, securely fastened to the fabric cover 46 prior to its attachment to the frame assembly 12. In a preferred embodiment, the fabric cover 46 is securely fastened to the frame assembly 12 by the resilient engagement of an elongated resilient clip band 52, formed from a suitable plastic material, with either the flange portions 28 of the frame members 20 and of the curved joints 22 to form the upholstered foundation 18 or the flange portions 26 of the frame members 20 and of the curved joints 22 to form the box or inner spring 15.

The resilient clip band 52 is sewn or otherwise securely fastened to the lowermost peripheral edge of the fabric cover 46 to enable the fabric cover 46 to be easily and rapidly secured to the frame assembly 12. The resilient clip band 52 may include one or more cutout or segmented portions 54 that enable the resilient clip band 52 to be bent around the corners of the base member 24 and to be attached to the flange portions 28 or 26 of the curved joints 22. The cutout or segmented portions 54 also prevent the obstruction of the attachment of the resilient clip band 52 due to its engagement with the support struts 32. Upon its secure engagement with either the flange portions 26 or the flange portions 28, the resilient clip band 52 is positioned out of the normal field of vision of an observer and, thus, is not readily visually discernible.

Obviously, many modifications and variations of the present invention are possible in light of the above teachings. For example, the resilient clip band 52 could be formed by a plurality of individual resilient clips securely fastened to the lowermost peripheral edge of the cover fabric 46. However, the use of the continuous resilient clip band 52 reduces the effort and time required to secure the fabric cover 46 to the frame assembly 12. Thus, it is to be understood that, within the scope of the appended claims, the invention may be practiced otherwise than specifically described.

What is claimed and desired to be secured by Letters Patent of the United States is:

1. An upholstered mattress base for supporting a mattress in a generally horizontally extending condition above a floor comprising a rigid frame assembly having a plurality of elongated frame members fastened together to form a rigid base member, said frame assembly comprising means for selectively mounting thereto a solid resilient cushion to form a foundation for supporting said mattress when said frame assembly is disposed in a first condition or mounting a spring assembly formed by a plurality of generally vertically extending coil springs to form a box spring for supporting said mattress when said frame assembly is disposed in a second, inverted condition, said selectively mounting means comprising a plurality of support struts extending across said rigid base member and supported by said frame members and disposed at the upper surface of said frame assembly for supporting said resilient cushion thereabove when said frame assembly is disposed in said first condition or disposed at the lower surface of said frame assembly for supporting said plurality of generally vertically extending coil springs thereabove when said frame assembly is disposed in said second condition, said spring assembly being absent when said frame assembly is disposed in said first condition, and a fabric cover disposed over either said resilient cushion when said frame assembly is disposed in said first condition or said spring assembly when said frame assembly is disposed in said second condition and secured to said frame assembly to thereby form said upholstered mattress base for supporting said mattress.

2. An upholstered mattress base as defined in claim 1 wherein each one of said frame members includes a first flange portion and a second flange portion spaced apart by a base portion to form a substantially U-shaped cross-sectional configuration in a plane transverse to the longitudinal axis of said frame member.

3. An upholstered mattress base as defined in claim 2 wherein said fabric cover is secured to said frame assembly by the resilient engagement of resilient clip means with said first flange portion when said frame assembly is disposed in said first condition.

4. An upholstered mattress base as defined in claim 2 wherein said fabric cover is secured to said frame assembly by the resilient engagement of resilient clip means with said second flange portion when said frame assembly is disposed in said second condition.

5. An upholstered mattress base as defined in claim 1 wherein said frame assembly further includes substantially rigid corner braces disposed in each of the corners of said base member and extending between and secured to at least two of said frame members, each of said corner braces including means for securely mounting a vertical support member when said frame assembly is disposed in either said first condition or said second condition.

6. An upholstered mattress base as defined in claim 1 wherein said frame members comprise metal frame members.

7. An upholstered mattress base as defined in claim 1 further comprising an elongated planar member disposed over said plurality of support struts when said frame assembly is disposed in said first condition, a resilient cushion being disposed over and secured to said planar member, said planar member being interposed between said resilient cushion and said plurality of support struts.

8. An upholstered mattress base as defined in claim 7 wherein said resilient cushion comprises an elongated sheet of polyurethane foam.

9. An upholstered mattress base as defined in claim 8 wherein said sheet of polyurethane foam comprises a substantially 3 inches thick sheet of polyurethane foam.

10. An upholstered mattress base as defined in claim 7 wherein said fabric cover is disposed over said plurality of support struts said planar member and said resilient cushion and secured to said frame assembly to form an upholstered foundation.

11. An upholstered mattress base as defined in claim 10 wherein said fabric cover includes means fixedly attached to said fabric cover prior to its being secured to said frame assembly for securing said fabric cover to said frame assembly.

12. An upholstered mattress base as defined in claim 11 wherein said securing means comprises resilient clip means sewn to said fabric cover.

13. An upholstered mattress base as defined in claim 12 wherein said resilient clip means comprises an elongated resilient clip band sewn to and extending at least substantially entirely around said fabric cover.

14. An upholstered mattress base as defined in claim 12 wherein each one of said frame members includes a first flange portion and a second flange portion spaced apart by a base portion to form a substantially U-shaped cross-sectional configuration in a plane transverse to the longitudinal axis of said frame member.

15. An upholstered mattress base as defined in claim 14 wherein said fabric cover is secured to said frame assembly by the resilient engagement of said resilient clip means with said first flange portions of said frame members.

16. An upholstered mattress base as defined in claim 1 further comprising a protective pad disposed over a spring assembly formed by a plurality of generally vertically extending coil springs when said frame assembly is disposed in said second condition, said spring assembly being interposed between said protective pad and said frame assembly.

17. An upholstered mattress base as defined in claim 16 wherein each of said coil springs is substantially 6 inches in length in a noncompressed condition.

18. An upholstered mattress base as defined in claim 16 wherein said fabric cover is disposed over said frame members, said spring assembly and said protective pad and secured to said frame assembly to form an upholstered box spring.

19. An upholstered mattress base as defined in claim 18 wherein said fabric cover includes means fixedly attached to said fabric cover prior to its being secured to said frame assembly for securing said fabric cover to said frame assembly.

20. An upholstered mattress base as defined in claim 19 wherein said securing means comprises resilient clip means sewn to said fabric cover.

21. An upholstered mattress base as defined in claim 20 wherein said resilient clip means comprises an elongated, substantially continuous resilient clip band sewn to said fabric cover.

22. An upholstered mattress base as defined in claim 1 further comprising a plurality of generally, vertically extending support means for positioning said frame assembly above a floor, said frame assembly including means for securely retaining said support means either below said resilient cushion when said frame assembly is disposed in said first condition or intermediate the uppermost and lowermost portions of said coil springs when said frame assembly is disposed in said second condition to thereby enable the same plurality of generally vertically extending support means to position said frame assembly above a floor in either said first condition or said second condition.

23. An upholstered mattress base for supporting a mattress above a floor comprising a rigid frame assembly having a plurality of elongated frame members fastened together to form a rigid base member, said frame assembly comprising means for selectively mounting thereto a solid resilient cushion to form a foundation for supporting said mattress when said frame assembly is disposed in a first condition or mounting a spring assembly thereto to form a box spring for supporting said mattress when said frame assembly is disposed in a second, inverted condition, said selectively mounting means comprising a plurality of support struts extending across said rigid base member and supported by said frame members and disposed at the upper surface of said frame assembly for supporting said resilient cushion thereabove when said frame assembly is disposed in said first condition or disposed at the lower surface of said frame assembly for supporting said spring assembly thereabove when said frame assembly is disposed in said second condition, and a fabric cover disposed over either said resilient cushion when said frame assembly is disposed in said first condition or said spring assembly when said frame assembly is disposed in said second condition and secured to said frame assembly to thereby form said upholstered mattress base for supporting said mattress.

24. An upholstered mattress base as defined in claim 23 wherein each one of said frame members includes a first flange portion and a second flange portion spaced apart by a base portion to form a substantially U-shaped cross-sectional configuration in a plane transverse to the longitudinal axis of said frame member.

25. A method of making an upholstered mattress base for supporting a mattress above a floor comprising the steps of assembling a frame assembly by interconnecting a plurality of elongated frame members to form a rigid base member and by securing a plurality of support struts to said base member such that said plurality of support struts are disposed at the upper surface of said frame assembly when said frame assembly is disposed in a first condition or are disposed at the lower surface of said frame assembly when said frame assembly is disposed in a second condition, inverted from said first condition, selecting only one of two operative modes for said mattress base, said two operative modes comprising a first operative mode in which said mattress base is physically configured as a foundation for a mattress and a second operative mode in which said mattress base is physically configured as a box spring for a mattress, selectively disposing said frame assembly in said first condition and securing a solid resilient cushion to said frame assembly for support by said plurality of support struts upon a selection of said first operative mode or disposing said frame assembly in a second condition, inverted from said first condition, and securing a spring assembly to said frame assembly for support by said plurality of support struts upon a selection of said second operative mode, drawing a fabric cover over said frame assembly and either said solid resilient cushion upon a selection of said first operative mode or said spring assembly upon a selection of said second operative mode and securing said fabric cover to said frame assembly to form said upholstered mattress base for supporting said mattress.

26. A method of making an upholstered mattress base as defined in claim 25 wherein said step of securing said fabric cover to said frame assembly comprises the step of placing resilient clip means fixedly attached to said fabric cover prior to its being secured to said frame assembly in resilient engagement with elongated portions of said frame assembly.

* * * * *